US008162802B2

(12) United States Patent
Berg

(10) Patent No.: US 8,162,802 B2
(45) Date of Patent: Apr. 24, 2012

(54) METHOD AND TOOL FOR EXERCISING MUSCLES

(75) Inventor: Ernst Hans Erik Berg, Stockholm (SE)

(73) Assignee: YoYo Technology AB (SE)

( * ) Notice: Subject to any disclaimer, the term of this patent is extended or adjusted under 35 U.S.C. 154(b) by 0 days.

(21) Appl. No.: 11/887,682

(22) PCT Filed: Mar. 30, 2006

(86) PCT No.: PCT/SE2006/050049

§ 371 (c)(1),
(2), (4) Date: Jan. 12, 2009

(87) PCT Pub. No.: WO2006/107266

PCT Pub. Date: Oct. 12, 2006

(65) Prior Publication Data

US 2009/0156362 A1 Jun. 18, 2009

(30) Foreign Application Priority Data

Apr. 5, 2005 (SE) ..... 0500744-8

(51) Int. Cl.
*A63B 71/00* (2006.01)
*A63B 21/22* (2006.01)

(52) U.S. Cl. ..... 482/2; 482/110

(58) Field of Classification Search ..... 482/1, 2, 482/8, 72–73, 110
See application file for complete search history.

(56) References Cited

U.S. PATENT DOCUMENTS 4,047,715 A * 9/1977 Gjessing ..... 482/64
4,184,678 A * 1/1980 Flavell et al. ..... 482/6
4,647,035 A * 3/1987 Yellen ..... 482/72
4,673,177 A * 6/1987 Szymski ..... 482/64
4,723,774 A * 2/1988 Monforte ..... 482/72
4,798,378 A * 1/1989 Jones ..... 482/72
4,846,460 A * 7/1989 Duke ..... 482/73
4,884,800 A * 12/1989 Duke ..... 482/73
4,930,770 A * 6/1990 Baker ..... 482/95
4,997,181 A * 3/1991 Lo ..... 482/73
5,072,929 A * 12/1991 Peterson et al. ..... 482/72
5,242,351 A * 9/1993 Berg et al. ..... 482/110

(Continued)

FOREIGN PATENT DOCUMENTS

GB 1043879 * 9/1966

(Continued)

OTHER PUBLICATIONS

"European Application Serial No. 06717133.0, Communication mailed Jan. 29, 2009", 4 pgs.

(Continued)

*Primary Examiner* — Loan Thanh
*Assistant Examiner* — Shila Jalalzadeh Abyane
(74) *Attorney, Agent, or Firm* — Schwegman, Lundberg & Woessner, P.A.

(57) ABSTRACT

The invention relates to a method for exercising muscles with the aid of an exercise apparatus and, where appropriate, for measuring exercise conditions, where the person exercising loads the relevant muscles by increasing or decreasing the rotational energy (E(kin)), kinetic energy, of at least one rotatably mounted flywheel, by means of a traction element which is wound up and designed for acting on the flywheel, the flywheel being braked in a controlled manner by means of a brake element. The invention also relates to an exercise apparatus for exercising muscles.

45 Claims, 6 Drawing Sheets

U.S. PATENT DOCUMENTS

| | | | | |
|---|---|---|---|---|
| 2002/0086777 | A1 * | 7/2002 | Charnitski | 482/110 |
| 2003/0032528 | A1 | 2/2003 | Wu et al. | |
| 2004/0087418 | A1 | 5/2004 | Eldridge | |
| 2005/0037902 | A1 * | 2/2005 | Charnitski | 482/110 |
| 2005/0085348 | A1 * | 4/2005 | Kiefer et al. | 482/72 |

FOREIGN PATENT DOCUMENTS

| | | | |
|---|---|---|---|
| GB | 2219410 | * | 6/1989 |
| GB | 2219410 | A | 12/1989 |
| GB | 2219410 | A * | 12/1989 |
| WO | WO-97/22389 | A1 | 6/1997 |
| WO | WO9722389 | * | 6/1997 |
| WO | WO 9722389 | A1 * | 6/1997 |

OTHER PUBLICATIONS

"PCT Application No. PCT/SE2006/050049, Written Opinion of the Searching Authority mailed Sep. 29, 2006", 5 pgs.

"European Application Serial No. 06717133.0, Response filed Jul. 8, 2009 to Communication mailed Jan. 20, 2009", 4 pgs.

"International Application Serial No. PCT/SE2006/050049, International Search Report mailed Sep. 29, 2006", 4 pgs.

* cited by examiner

METHOD AND TOOL FOR EXERCISING MUSCLES

RELATED APPLICATIONS

This application is a nationalization under 35 U.S.C. 371 of PCT/SE2006/050049, filed Mar. 30, 2006 and published as WO 2006/107266 A2 on Oct. 12, 2006, which claimed priority under 35 U.S.C. 119 to Sweden Patent Application Serial No. 0500744-8, filed Apr. 5, 2005; which applications and publication are incorporated herein by reference and made a part hereof.

TECHNICAL FIELD

The present invention relates to a method for exercising muscles and, where appropriate, for measuring exercise conditions, in accordance with the preamble of claim 1.

The invention also relates to an exercise apparatus for exercising muscles, in accordance with the preamble of claim 13.

BACKGROUND

Physical exercise is usually performed either as endurance exercise (aerobic exercise) characterized by continuous muscle work of large muscle groups and by a resulting feeling of shortness of breath (high pulse rate and respiration rate), sweating and general fatigue; or as strength training, characterized by intermittently high muscle tension of individual muscle groups, by performing short sequences (at most 15 muscle contractions to almost maximum muscle tension) with long rest intervals in between; of a number of different specific exercises. There are a number of technical differences between these two types of exercise, as will be explained below.

Regardless of the type of exercise involved, the internal work performed by the muscles can be divided into two different categories. In concentric work, also referred to as positive work, the muscle shortens (contracts) under an applied load. In eccentric work, also referred to as negative work, the muscle by contrast lengthens during the muscle work. For example, it is concentric work that is mainly performed when lifting a dumbbell, whereas eccentric work predominates when lowering and decelerating the weight. For a given speed of change in length, often expressed as joint angle velocity, the skeletal muscles generate a greater force in eccentric work (braking) than in concentric work (pushing). In concentric muscle work, the maximum force generated by the muscle reduces dramatically as the speed of length change (speed of contraction) increases. By contrast, the power generated by the muscle, consisting of the product of generated force and speed of movement, initially increases with increasing speed of contraction and reaches its maximum at moderately rapid concentric muscle work, when the energy requirement of the person exercising is also at its maximum. In eccentric muscle work, the power generated/the energy requirement is relatively modest.

For optimum strength-training, a high level of muscle tension is required, and preferably a limited energy requirement. Scientific studies have also shown that combined eccentric and concentric muscle work with a heavy load and at slow speeds of movement affords the greatest increase of muscle mass and strength. Consequently, a modern and high-quality strength-training apparatus provides such a load profile. SE 8900946-8 describes a method for exercising muscles by loading by means of a flywheel instead of conventional weights or dumbbells, on the one hand for the purpose of reducing the total weight of the strength-training apparatus for space flight, recreation or rehabilitation, but also for producing an optimum load profile during the eccentric phase of the muscle work.

Optimum condition-training requires, in the first place, a high energy requirement of the exercised muscles in order to achieve improved endurance of both the heart and also the peripheral muscle groups of the person doing the exercise. Higher speeds of movement are typically used compared to strength-training, thus achieving greater energy requirement and oxygen uptake. Some exercise apparatus, such as exercise bikes and rowing machines, additionally use a predominantly concentric muscle load, the eccentric muscle load being reduced by friction, thereby reducing the absolute force load.

Conventional exercise equipment cannot usually provide both strength-training and condition-training in one and the same apparatus, since, in accordance with the above description, the technical requirements differ considerably. Therefore, the construction and choice of material are generally optimized for one or other exercise regime.

OBJECT OF THE INVENTION

The object of the present invention is to make available an exercising method and an exercise apparatus which can create a high loading and well-defined speed profile during concentric-eccentric muscle work without any appreciable energy losses; is suitable for strength-training, as a predominantly concentric muscle loading at high speed of movement; suitable for condition-training.

DISCLOSURE OF THE INVENTION

These and other objects, which will become evident from the description below, are achieved by means of a method for exercising muscles and an exercise apparatus for exercising muscles in accordance with the above, and further having the features set forth in the characterizing parts of attached independent claims 1 and 13, respectively. Preferred embodiments of the muscle-exercising method and of the exercise apparatus for muscle exercise according to the invention are defined in the attached dependent claims 2-12 and 14-47, respectively.

Since the invention relates to a method for exercising muscles by means of an exercise apparatus and, where appropriate, for measuring exercise conditions, where the person exercising loads the relevant muscles by increasing or decreasing the rotational energy (E(kin)), kinetic energy, of at least one rotatably mounted flywheel, by means of a traction element which is wound up and is designed for acting on the flywheel, and further characterized in that the flywheel is braked in a controlled manner by means of a brake element, it is possible to perform both strength-training and also condition-training with the same exercise apparatus.

Since the invention relates to an exercise apparatus for exercising muscles and, where appropriate, for measuring exercise conditions, where at least one rotatably mounted flywheel is provided for loading the relevant muscles of the person exercising by increasing or decreasing the rotational energy (E(kin)), kinetic energy, of the flywheel, with a wound-up traction element being provided with which the person exercising is able to act on the flywheel, and further characterized in that the brake element is provided to brake the flywheel in a controlled manner, it is possible to perform both strength-training and also condition-training with the apparatus. It is also possible to produce a lightweight apparatus which takes up minimal space since no weights are required and there is no need for separate equipment for strength-training and for condition-training, respectively, and the apparatus can advantageously be used for home exercise and for rehabilitation of most of the muscle groups of the body. The apparatus can advantageously be used in a number of areas where the above features are required, including in space flight.

DESCRIPTION OF THE FIGURES

The present invention will be more clearly understood with reference to the attached detailed description when read in conjunction with the attached drawings, in which identical reference numbers designate identical parts in the many views, and in which.

DETAILED DESCRIPTION OF THE INVENTION

Figure 1:
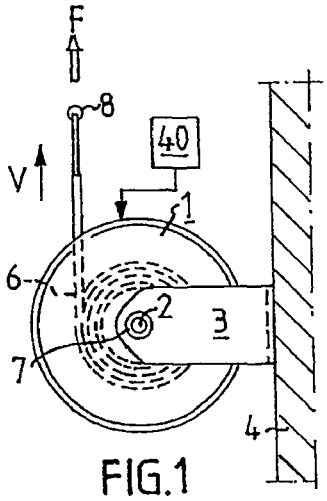
FIG. 1 is a schematic representation of a first embodiment of an arrangement 110 according to the invention, seen at right angles to the plane of the flywheel.
Figure 2:
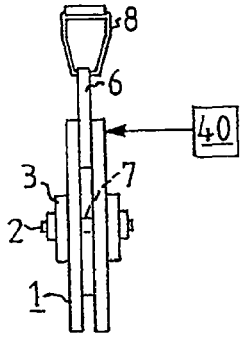
FIG. 2 shows the arrangement according to FIG. 1, seen from the left in FIG. 1.
Figure 3:
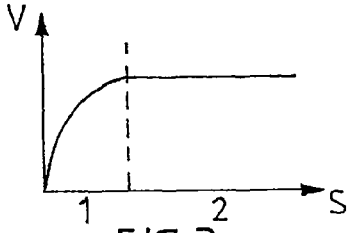
FIG. 3 shows the run-out speed as an often preferred function of the extended length.
Figure 4:
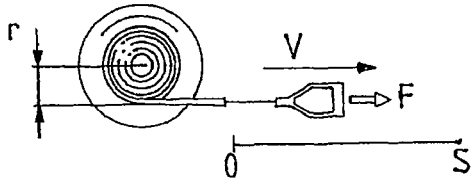
FIG. 4 shows a sketch of an arrangement according to the invention intended to explain the reference signs.

An exercise apparatus is shown in FIGS. 1 and 2. Reference number 1 designates a rotatably mounted flywheel 1, reference number 2 designates an axle about which the wheel 1 can rotate, and reference number 3 designates a bracket structure mounted on a wall 4 or the like for securing of the wheel 1, where reference number 4 can also constitute part of the apparatus. For loading the relevant muscles of a person 5 who is exercising, the flywheel 1 is designed for increasing or decreasing its rotational energy (E(kin)), kinetic energy. According to the embodiment shown in FIGS. 1 and 2, a traction element 6 in the form of a belt 6 or the like is provided for applying said energy, said traction element being wound up around a hub part 7 of the wheel 1 and being provided with a handle part 8 which is intended to be gripped by the person exercising who, as part of the exercise procedure, can pull the belt 6, when the latter is wound up, whereupon the belt is unwound and said energy is increased, or else pull the belt, hold the belt 6, when the belt has been unwound and the wheel is set in rotation, whereupon the rotation of the wheel is braked. Consequently, this is suitable for strength-training, since the user can obtain both eccentric and also concentric loading close to the maximum muscle force. It is also possible to achieve heavier eccentric than concentric exercising by braking the flywheel during a shorter period of time, so-called eccentric overload.

Figure 17A:
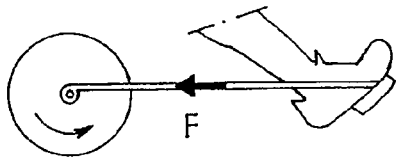
Figure 17B:
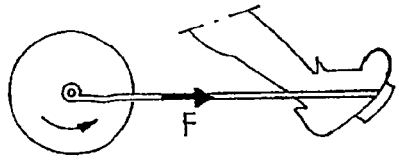

FIGS. 17*a* and 17*b* illustrate concentric and eccentric muscle movements, respectively.

The traction element 6 is preferably coupled directly to and wound around the axle 2 about which the flywheel rotates. Alternatively, the traction element 6 can be wound around a separate axle, which axle is designed to transmit the rotation force to the axle 2 of the flywheel 1 via force-transmission members, for example a gear wheel, transmission belt or the like.

The exercise apparatus moreover comprises a brake element 40, shown schematically in FIGS. 1 and 2 and arranged to brake the flywheel 1 in a controlled manner, in order to permit satisfactory condition-training with the exercise apparatus. By braking the flywheel 1 by means of a brake element 40 in the eccentric phase, i.e. when the belt is wound up on the hub again, an exercise movement suitable for condition-training is obtained. In condition-training, the brake element 40 can be designed to brake both in the concentric phase, i.e. in the pull-out phase, and the eccentric phase, i.e. the winding-up phase. Alternatively, the brake element 40, in condition-training, can be designed to brake in a controlled manner only in the eccentric phase. The brake element 40 is preferably designed for an engageable and disengageable braking action, such that it can be disengaged in strength-training, at least in the eccentric phase.

Figure 18:
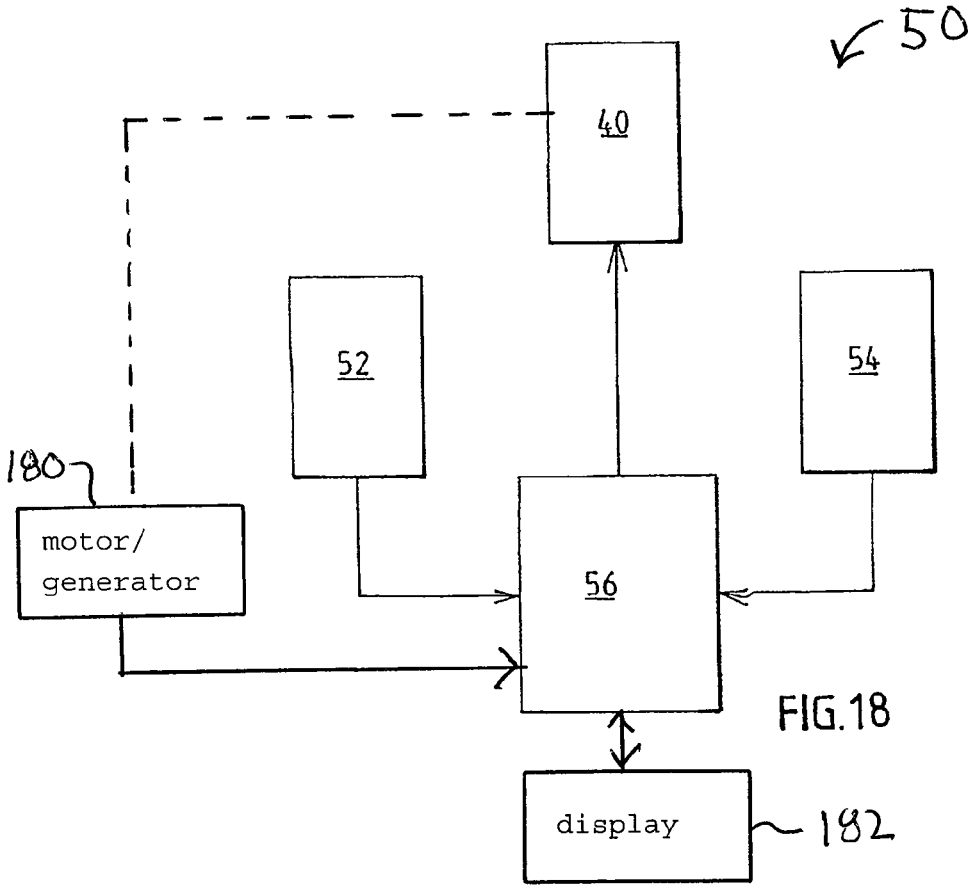
FIG. 18 is a schematic representation of a control element for controlling the braking action of a brake element provided for braking the flywheel.

The exercise apparatus preferably comprises a control arrangement 50 which is shown schematically in FIG. 18 and is designed to control said brake element 40. According to one embodiment, the control arrangement 50 consists of a mechatronic system designed to detect the initiation of the concentric phase or eccentric phase. The mechatronic system preferably comprises a first sensor 52 intended to detect the concentric phase, and a second sensor 54 intended to detect the eccentric phase, and a control element 56, for example a microprocessor, to which the sensors 52, 54 are coupled, and which control element 56 is designed to convey control signals to the brake element 40. The first sensor 52 is preferably a rotation sensor 52 which is designed to record when the axle 2 about which the flywheel 1 rotates changes direction, which happens when the traction element 6 has been wound up and the user exerts a traction force on the traction element, i.e. in the pulling-out phase or the concentric phase. The second sensor 54 is preferably an optical sensor which, according to one variant, is designed to record when the traction element 6 is fully pulled out, by detecting the then exposed axle 2 to which the traction element is fixed, whereupon the eccentric phase follows. In condition-training, in the case where the brake element 40 is only intended to brake in the eccentric phase, the mechatronic system is designed to deactivate the brake in the concentric phase, by means of the first sensor 52, and then to activate the brake in the eccentric phase, by means of the second sensor 54, so that the load on the user is removed, and thereafter to once again deactivate the brake 40, by means of the first sensor, in the next pulling-out phase, and so on for the whole of the exercise session. The braking action is preferably designed to be controlled via signals from the first and second sensors 52, 54 via the control element 56 to the brake element 40.

According to one aspect of the invention, the braking action is intended to be controlled via signals from the sensors 52, 54 in such a way that the braking action is dependent on the speed of the flywheel 1, 1*a*, which can be of advantage when a friction brake is used in accordance with the description below. Brake control can be effected, for example, by means of a stepping motor, or a magnet.

The exercise apparatus preferably comprises a manoeuvring element for regulating the braking action of the brake element. The manoeuvring element is preferably connected electrically to the brake element so that a user can control the braking action, for example via a display. The manoeuvring element can alternatively be connected mechanically, in which case the user can manually control the brake element.

According to one embodiment, the brake element 40 is designed to brake the flywheel 1 directly. Alternatively, the exercise apparatus comprises a second flywheel 1*a* which is rotatable about the axle in the same way as the flywheel 1, in which case the brake element 40 is designed to act directly on the second wheel so that the flywheel 1 is braked indirectly. The advantage of having a second wheel which the brake element 40 is designed to brake directly is that the flywheel 1 can be easily exchanged without parts of the brake element 40 getting in the way. In some situations, it may be desirable to change the size of the flywheel 1. For example, in cases when changing from strength-training to condition-training, or when changing over between users with very different muscle strength, or combinations of these situations.

There are several known ways of braking a flywheel. Different embodiments of the invention are described below in which known braking concepts are adapted to be used for braking the flywheel 1 according to the present invention.

Figure 19:
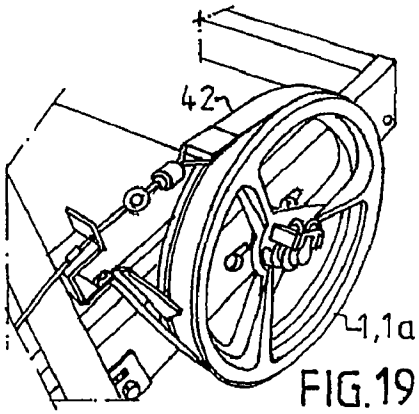
FIG. 19 is a schematic perspective view of an arrangement for friction-braking of the flywheel by means of a brake band.

According to a first embodiment of the invention, the brake element is a friction brake, i.e. the brake element is designed to brake the flywheel by means of friction. There are many variants of braking by means of friction. In the flywheel shown in FIG. 19, a brake band 42 is arranged for friction breaking via direct contact with the periphery of the flywheel. It is also possible to imagine an embodiment in which at least one brake shoe or brake block creates corresponding frictional resistance. Alternatively, corresponding frictional resistance can be produced by the brake force from at least one brake shoe or brake block acting on the side of the wheel. These braking methods can be adjusted relatively simply in order to control the frictional resistance. The wheel speed is preferably braked both during the accelerating and also the decelerating phase of the rotation of the flywheel 1, 1*a*, so that a braking force from the person exercising, i.e. eccentric muscle activity, is substantially completely replaced. The braking force via brake belt or block is varied with the force applied to the flywheel 1, 1*a*. The energy loss as heat, which the person exercising does not have to recover through eccentric muscle activity, increases with the speed of rotation.

According to a second embodiment of the present invention, the brake element is a fluid brake, i.e. the brake element is designed to brake the flywheel by means of a fluid 400, such as air or water.

Figure 20:
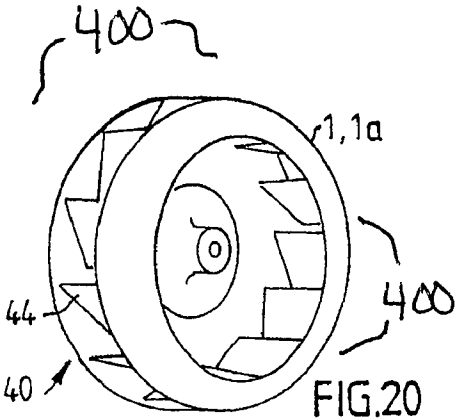
FIG. 20 is a schematic perspective view of an arrangement for braking the flywheel by means of an air brake.

In one variant shown schematically in FIG. 20, the flywheel comprises blades 44 which are arranged such that the flywheel, when rotated, has the effect of an impeller wheel and in this way creates a frictional resistance through air resistance. The air resistance can be regulated by adjusting the inlet area for the flow of air. Alternatively, the flywheel comprises spokes which extend out from the hub and form blades.

These or similar blade wheels can also be used in a water bath, where frictional resistance is thus created by the water contact resistance. Several variants of brake wheels in air and water are conceivable. The braking resistance increases with increasing rotation speed, and the energy loss to the braking arrangement increases progressively. A water-braked blade wheel provides a greater braking action than an air-braked blade wheel since water has a greater density, for which reason the water wheel does not have to work completely enclosed in a volume of water, and instead it suffices if the water covers only a small part of the wheel. With a water-braked wheel, a further braking effect is also obtained through the friction that occurs between the water and the blades, which effect is more or less negligible in the air-braked wheel. The advantage of the air-braked wheel is that a simpler construction is achieved, since water is not used.

Figure 21:
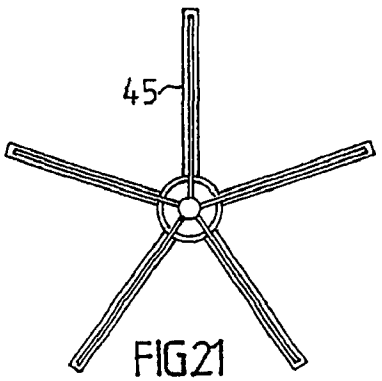
FIG. 21 is a schematic side view of an arrangement for regulating the braking action of an air brake.

FIG. 21 is a schematic representation of an alternative variant in which a blade wheel comprises adjustable blades 45, where the blades are arranged such that their radius can be varied, and this can be achieved by means of a telescope function. This makes use of the fact that the brake torque increases with quadruple ($r^4$) the blade radius.

According to a third embodiment of the present invention, the brake element is an induction brake, i.e. the brake element is designed to brake the flywheel by means of induction. In accordance with braking by means of a brake block, as above, different forms of magnets are conceivable for creating similar braking resistance in relation to the periphery of the wheel, without direct contact. The braking magnetic resistance increases as the rotation speed increases, with the energy loss to the brake device increasing progressively.

As braking magnet, a permanent magnet can be used without the need for a further energy source. There are several variants of permanent magnets that are suitable for braking the flywheel. One variant involves placing several permanent magnets in a block which is designed to brake against the periphery of the flywheel. A manoeuvring element is preferably provided with which the distance between the block and the wheel can be varied. An advantage of such an arrangement is that it takes up little space. A further advantage is that the clutch can be easily disengaged via the manoeuvring element for strength-training.

Another alternative of a permanent magnet involves securing a disc with magnets in the machine frame, on the axle, with the wheel being placed outside. In order to vary the resistance, the disc is mounted displaceably in the axial direction or can be angled away from the wheel. An advantage of this solution is that it provides a large overall contact area between the magnets and the wheel. A disadvantage is that the magnetic disc takes up one axle end and the magnetic field losses are quite considerable.

Figure 22B:
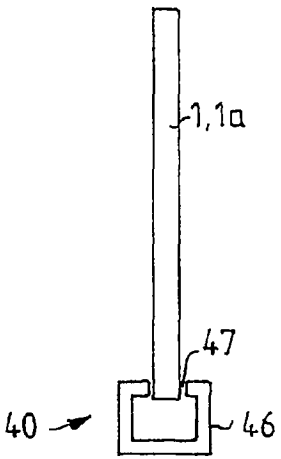
FIGS. 22*a* and 22*b* are a schematic side view and schematic front view, respectively, of an arrangement for braking the flywheel by means of a permanent magnet.
Figure 22A:
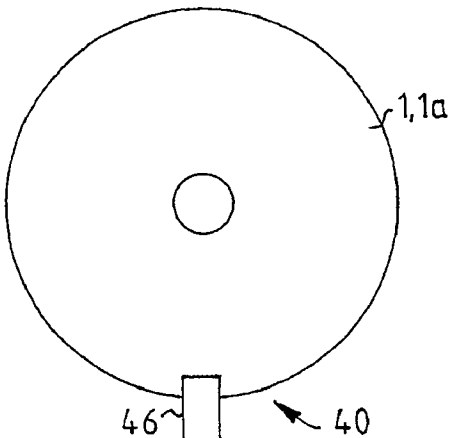
Figure 24:
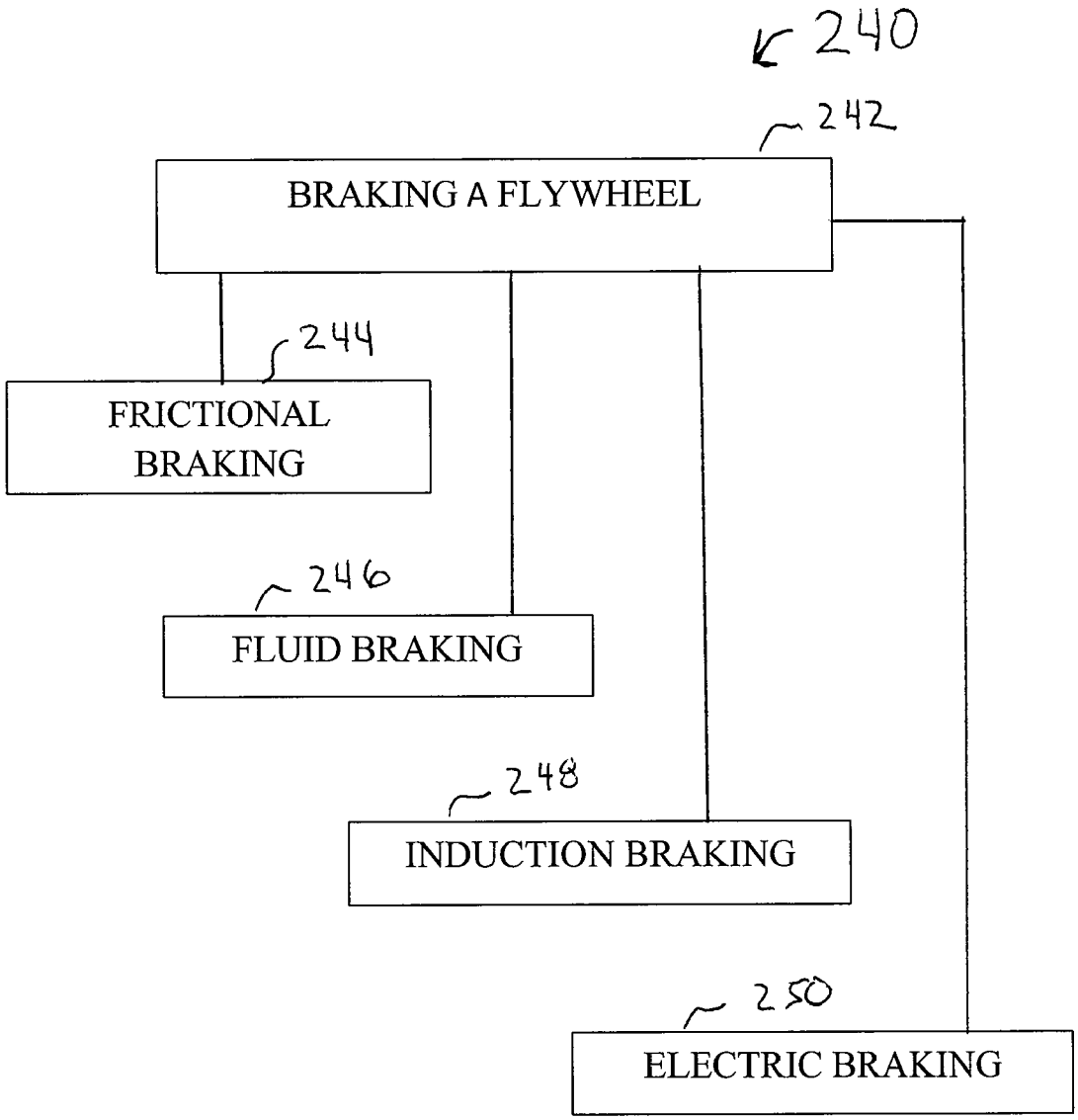
FIG. 24 includes a flowchart of various methods 240 including braking a flywheel 242, frictional braking 244, fluid braking 246, induction braking 248, and electric braking 250.

A further alternative of a permanent magnet is shown schematically in FIGS. 22*a* and 22*b*. The permanent magnet according to the invention comprises a magnet core 46 which is arranged at the periphery of the wheel, with an opening 47 so that the periphery of the wheel can rotate within said opening 47. With the magnet core, the magnetic flux is introduced into the system. To adjust the braking action, the circuit's pole gap that acts on the wheel is designed to be altered. The advantage of this concept is that the losses in the magnetic field decrease since it is oriented by the core.

Figure 23:
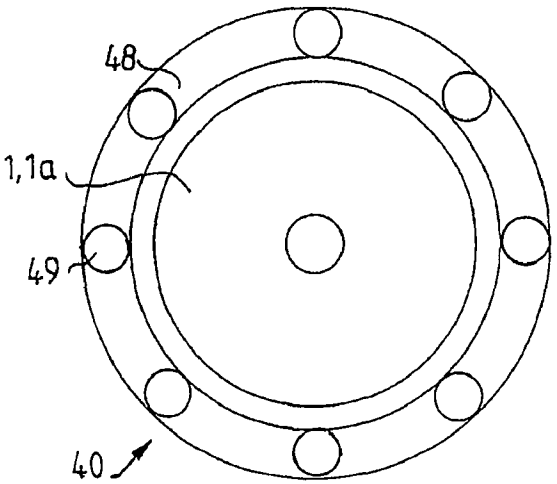
FIG. 23 is a schematic side view of an arrangement for braking the flywheel by means of an electromagnet.

It is also possible to use an electromagnet to achieve a similar technical braking effect. This braking effect can then be adjusted dynamically during the wheel rotation with or without feedback coupling from the wheel's measured speed of revolution. A variant of an electromagnet is shown in FIG. 23. A casing 48 is intended to be secured in the machine, which casing 48 is arranged around the flywheel 1, 1*a*, and in which casing there are coils 49 coupled to a current source. The flywheel 1, 1*a* is arranged so that the magnetic field of the coils 49 brakes the flywheel along its periphery. An advantage is that the magnetic field strength can be varied by changing the flow through the winding of the coils, so that the user can exercise against a predetermined force independently of the exercise frequency. By interrupting the current supply, the braking action is disengaged and the wheel can be used for strength-training.

According to a fourth embodiment of the present invention, the brake element 40 is an electric brake, i.e. the brake element is designed to brake the flywheel 1, 1*a* by means of electricity. For example, an electric motor/generator can be provided for braking the flywheel 1, 1*a*.

According to one aspect of the invention, a combination of one or several of the abovementioned brake elements—friction brake, fluid brake, induction brake and electric brake—can be used to produce the braking action on the flywheel 1, 1*a*.

As regards the possibilities of varying the characteristics of the apparatus, particular flexibility is afforded by a combination of varying the moment of inertia and the proposed variants of the brake design.

It is often preferable to exercise under almost maximum muscle tension and with controlled speed of contraction/lengthening. A constant contracting or lengthening speed in the muscle is provided by a defined belt outlet speed, which depends on the actual joint anatomy and on the position of the flywheel. However, the variation in the pull-out speed is often limited, as has been described in detail in our earlier patent application SE 8900946-8.

Figure 5:
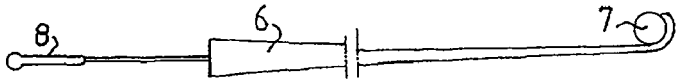
FIG. 5 is a schematic representation of a traction element, a traction belt, seen transverse to its longitudinal direction and its thickness direction.

In the embodiment of the traction belt arrangement shown in FIG. 5, the speed of reduction in thickness of the belt decreases in the direction away from the handle. FIG. 5 thus illustrates a way of varying the torque in relation to the flywheel for influencing the relationship between the force exerted and the speed of muscle contraction or muscle lengthening.

Figure 6:
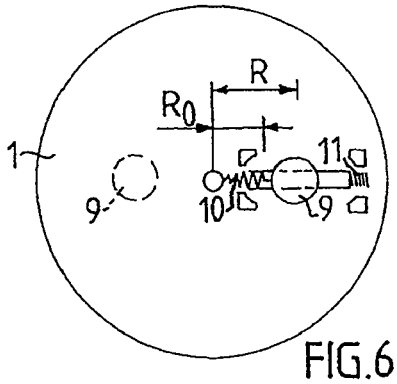
FIG. 6 is a schematic side view of a flywheel designed for varying the moment of inertia by means of varying weight distribution.

In the flywheel shown in FIG. 6, it is arranged so that its moment of inertia can be varied by variation of the weight distribution during rotation, so as to influence the relationship between the force exerted and the speed of muscle contraction or muscle lengthening. In the embodiment shown, the flywheel includes at least one weight 9 which can be moved in the radial direction and which is intended to be displaced for redistribution of the weight under the influence of the rotational forces, centripetal forces etc. that occur. The moment of inertia increases when the weight is moved outwards. The weight is preferably displaced with a spring force, for example via a helical spring 10 which is located inwardly in relation to the weight and is tensioned when the weight is displaced outwards. Reference number 11 designates a powerful limit spring positioned externally in relation to the weight. Particularly during stage 1, when acceleration is to take place, it is not practical to apply such an extreme change in traction belt thickness required for achieving a substantially constant pull-out speed v. In this respect, it is expedient to use redistribution of the weight in order to change the moment of inertia J. In this respect, the characteristics of said tension spring 10 can be used to control the change of J depending, inter alia, on the angular speed w. The flywheel may have several weights, as indicated by the weight 9 shown by broken lines in FIG. 6, the various weights 9 conceivably having different springs 10, so as to achieve a high degree of flexibility with regard to the change in J. The movement of the weight concerned is stopped by means of the limit spring 11, whereupon the change in J originating from this weight ceases. It is also conceivable to imagine an arrangement in which the weights are fixed in the radial direction, both below and above given rotational speeds.

Figure 7:
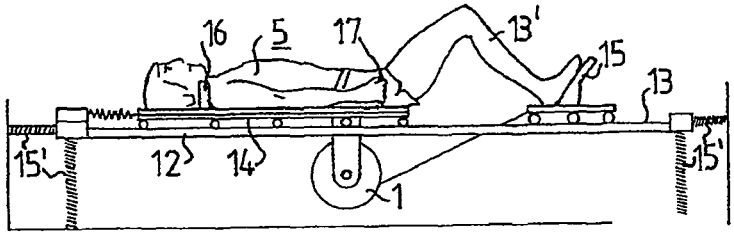
FIG. 7 is a schematic side view of an arrangement for exercise, particularly in a weightless environment.

In the arrangement shown in FIG. 7, which is intended for use in a weightless environment, a bed part 12 is provided with a foot end 13 and is intended to support the person exercising 5. The embodiment shown here includes a slide 14 which is movable along said bed part and on which the person exercising is intended to lie and to which a flywheel 1 is connected. The bed part 12 is anchored releasably to surrounding walls or the like with the aid of spring devices 15'. The flywheel 1 is connected via the traction belt to a carriage 15 which is movable along the foot end of said bed part, the flywheel being activated by the legs 13' of the person via said carriage and said traction belt. An embodiment is shown in which flywheel is located beneath the reclining plane of the bed part; for example, the traction belt runs between the flywheel and the carriage via a central recess (not shown) in the bed part. Reference number 16 designates a shoulder support, and reference number 17 designates a handle to be gripped by the training person. By means of the arrangement shown, the movable mass has been minimized since moving the flywheel relative to the person exercising is not necessary.

Figure 8:
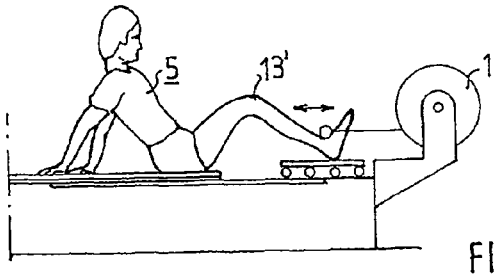
FIG. 8 is a schematic side view of part of another arrangement for leg-training in a reclining position.

In the arrangement shown in FIG. 8, a flywheel is mounted on a more conventional bed. In the example shown, the flywheel is mounted at the foot end of the bed, so that the traction belt is pulled out in the direction towards the head end of the bed. In this case too, a carriage is used for supporting the feet of the person exercising. Embodiments are of course conceivable in which the flywheel, as illustrated in FIG. 7, is located beneath the bed. The arrangements according to FIGS. 7 and 8 can be used for advanced strength-training with high movement speeds, as a result of the low movable mass.

Figure 9:
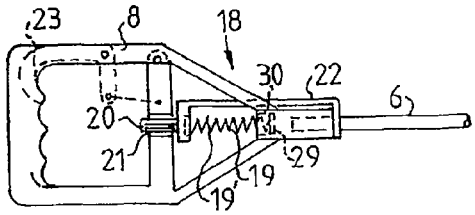
FIG. 9 is a schematic representation of a safety release device which is arranged in a handle part and which is designed, under certain conditions, to break the connection between handle part and traction element.

FIG. 9 illustrates the design of devices allowing the training person to activate the flywheels where the devices, preferably in conjunction with a handle part 8 intended to be gripped by the person exercising, comprise a safety release arrangement 18 for safety purposes, which is designed such that the connection between the person exercising and the flywheel is broken when a defined traction force is exceeded.

Figure 10:
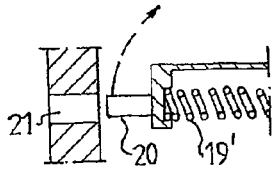
FIG. 10 shows part of a release device according to FIG. 9 in its released state.

In the embodiment shown in FIGS. 9 and 10, the release arrangement includes a spring connection 19 between the person exercising and the flywheel, wherein a release pin 20 is arranged so that, in its non-released position, shown in FIG. 9, it adopts a latching position in a latching space 21 and, when the traction force F increases sufficiently, is withdrawn successively from said latching space against a spring force, and is removed from the latching space when a defined traction force is exceeded, FIG. 10, said connection being broken by means of the spring 19' and pin being removed from the handle part via a traction belt connection 22.

The release pin 20 and the latching space 21 are preferably provided in the handle part.

Reference number 23 designates a manual safety-release catch, shown in broken lines, for opening the latch space to an extent such as to enable the release pin to leave the latching space, so that said connection is broken.

Figure 11:
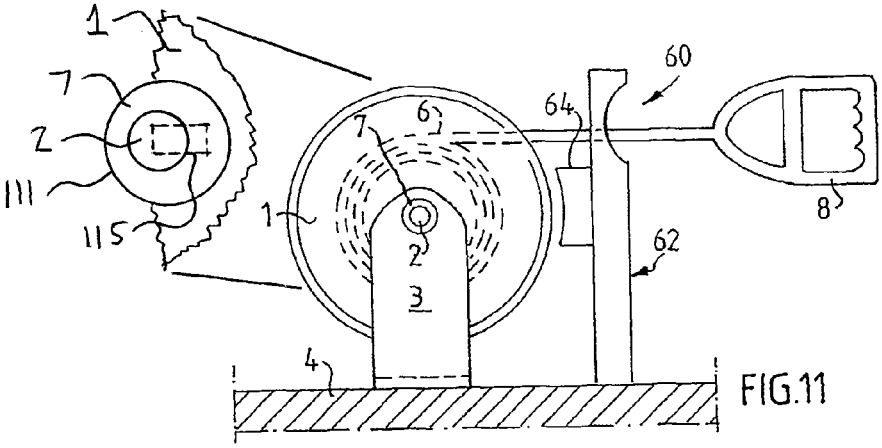
FIG. 11 is a schematic representation of a safety system for stopping the flywheel for safety reasons.

The exercise apparatus according to the present invention preferably comprises a safety system 60 designed to prevent uncontrolled movement of the flywheel. FIG. 11 is a schematic representation of an embodiment in which the safety system 60 comprises an emergency brake 62 designed to stop the flywheel in the event of uncontrolled run-in of the traction element/traction handle, for example if the handle part 8 of the traction element 6 is let go during use. The emergency brake preferably comprises a brake shoe 64 which is designed such that, in the event of uncontrolled run-in of the traction element, it is acted upon by the handle or another device secured on the traction element, the brake shoe 64 being arranged to brake directly against the periphery of the flywheel 1 so that the flywheel is stopped. In this way, the person exercising is protected from being injured during exercising.

According to one embodiment, the safety system comprises a disengagement element which, in the event of too high a torque of the flywheel 1, is designed to disengage said flywheel from the axle 2. According to one variant, the disengagement element comprises an exchangeable breakpin 115 which is coupled by locking between the axle 2 and the hub of the flywheel 1, the breakpin being designed to be shorn off in the event of overloading, i.e. at a defined torque of the flywheel. The exercise apparatus is protected in this way. The safety system preferably comprises both the emergency brake and the disengagement element.

According to an alternative preferred embodiment, the safety system comprises an adjustable slip-clutch element 111 designed to disengage the flywheel from the axle 2 at a predetermined torque. According to one variant, the slip-clutch element is designed to slip when the torque is too high. Alternatively, it is reset.

It is often desired to measure the exercise or training performance quantitatively and qualitatively, not least for research purposes. Force transducers are preferably used which are positioned in the handle part 8 or footrest of the carriage 15. Rotation transducers 52 are expediently also provided, and sensors for the run-out speed, preferably placed close to the flywheel. Devices are also expediently provided (not shown here) for recording, processing and monitoring the exercise or performance concerned. A number of functions are conceivable in this regard. For instance, said devices for recording, etc., may be designed to deliver a signal when the traction speed (pulling-out speed) varies in an undesirable manner, or when the pulling force falls below a predetermined value. The recording devices can also be designed to record work performed ($\int Fds$) and thus the instantaneous kinetic energy. There are also measuring elements (not shown) for measuring and preferably recording the temperature. The measuring element expediently comprises an electric motor/generator 180 designed to brake the flywheel for measuring and preferably recording the speed of rotation. The electric motor/generator is preferably designed to generate energy for operating the measurement equipment and display 182.

Figure 12:
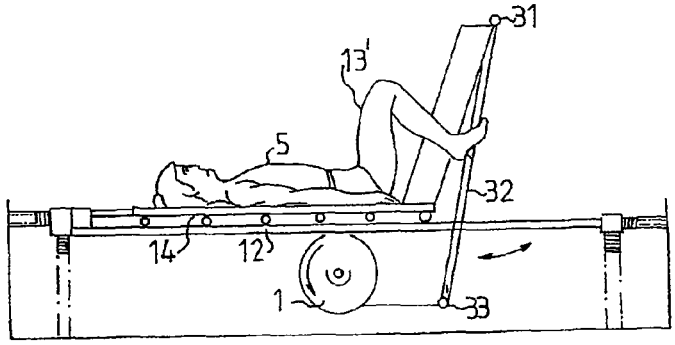
FIG. 12 is a schematic side view of an arrangement substantially in accordance with FIG. 7, but with the flywheel designed to be activated indirectly via a lever arm.

In the embodiment shown in FIG. 12, essentially of the same type as that shown in FIG. 7, a lever arm 32 is provided which is pivotably suspended at its upper end 31 and which, at its lower end 33, is connected to the traction element and is intended to be activated by the training person, preferably between said ends 31, 33. By means of the lever arm, the pulling force on the flywheel is reduced compared to an arrangement according to FIG. 7, at substantially the same force exerted by the training person.

Figure 13:
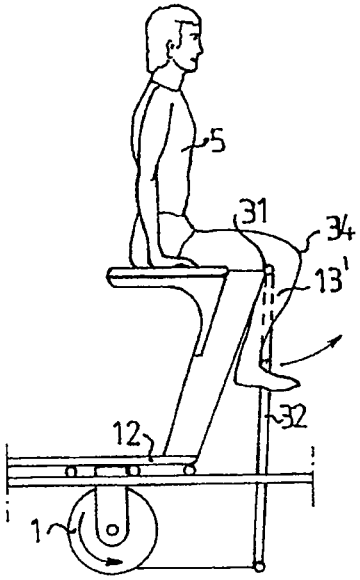
FIG. 13 is a schematic representation of part of an arrangement substantially according to FIG. 12, designed for a sitting person to exercise by means of knee stretches.
Figure 14:
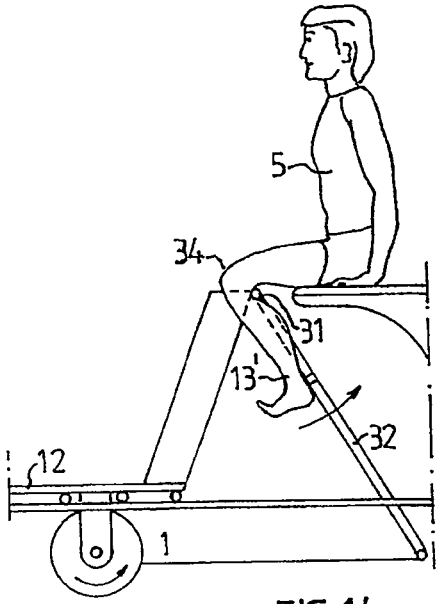
FIG. 14 is a schematic representation of the arrangement according to FIG. 13 designed for a sitting person to exercise by means of leg-curl exercises.
Figure 15:
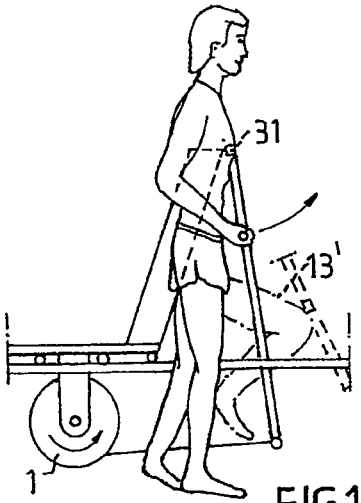
FIG. 15 is a schematic representation of the arrangement according to FIG. 13 designed to allow a sitting or standing person to perform arm-curl exercises.
Figure 16:
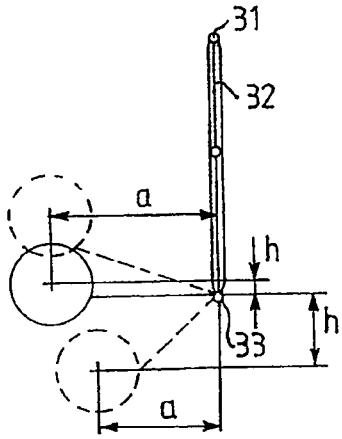
FIG. 16 is a schematic representation of various positions of the flywheel in relation to the free, loaded end of the lever arm in the case of an arrangement substantially according to FIGS. 12-15, FIGS. 17*a* and 17*b* are schematic representations of concentric and eccentric muscle exercise, respectively.

FIGS. 13-15 show the use of a combined lever arm and flywheel for different types of exercise. The joint 34 concerned is placed near the articulated suspension end 31 of the lever arm. As will be seen from the figures, there are many possibilities for varying the exercise performed with the apparatus. FIG. 16 shows further possibilities of varying the characteristics of the arrangement. For instance, the rotation axle of the flywheel, and thus the point at which the pulling force F engages the flywheel via the traction element, can take different positions in relation to the end 33 of the lever arm where the traction element is mounted on the lever arm 32. The system (FIG. 16) is defined geometrically by the height h of the rotation axle above or below a horizontal line passing through the end 33, and the horizontal distance a of the rotation axle from the end 33.

The length of the lever arm and the actual moment arm with which the traction element attacks the flywheel will also be known. The characteristics of various exercise sequences can be determined by relatively simple trigonometric deliberations.

The method according to the invention and the mode of operation of the apparatus according to the invention will have been understood in all essentials from the foregoing. The muscles concerned are thus subjected to loads by increasing or decreasing the kinetic energy of at least one flywheel. A concentric phase, i.e. a pulling-out phase, is thus followed directly by an eccentric phase, i.e. a run-in phase, since the flywheel continues to rotate under the effect of the rotation it has been imparted during the pulling-out phase. Since the brake elements are designed to brake the flywheel in a controlled manner, this means that condition-training is possible when the brake element is designed to act on the flywheel at least in the eccentric phase, and strength-training is permitted when the brake element is disengaged at least in the eccentric phase.

The characteristics of the arrangement can be varied in several ways. The geometry and/or moment of inertia of the traction element can be used to vary the relationship between the force exerted and the speed of muscle contraction/muscle lengthening, and the positioning of the flywheel can be used, and the control of the brake elements action on the flywheel. In the example described, a constant pulling-out speed has been assumed. However, a selected speed profile can be predetermined. Other parameters, such as tensile force of the traction element, can of course be predetermined as regards profile. In light of known data concerning joint movements, which data often specify the torque in the joint, it is possible to determine, for example, corresponding pulling force in the traction element and to adapt training to what is known, by predetermining the exercise conditions with the aid of the possibilities of varying the characteristics of the arrangement.

The action of the brake element on the flywheel can also be regulated and varied according to the requirements.

The invention has been described above with reference to illustrative embodiments. It will be understood, however, that other embodiments and minor modifications are conceivable without thereby departing from the concept of the invention.

As regards the possibilities of changing the characteristics by varying the position of the flywheel, this will apply not only when a lever arm is provided, but also when the traction element is acted upon directly by the person exercising.

Thus, considerable variations are possible with respect to the belt thickness, for example an alternating increasing and decreasing thickness along the belt.

As regards an arrangement intended for exercise in a weightless environment, such an arrangement can in principle also be used in a normal environment where gravity exists. In this case, the arrangement is set up on a floor or the like. The arrangements shown in FIGS. 13-15 do not, in themselves, need to be configured substantially in the same way as the arrangements according to FIG. 12, but may be configured in other suitable ways. It can generally be said that the way in which the flywheel is arranged for different purposes can be varied within wide limits.

The invention is therefore not to be regarded as being limited to the above embodiments, and instead it can be varied within the scope of the attached claims.

The invention claimed is:

1. A method of exercising muscles, wherein the method comprising the steps of:

using an exercise apparatus comprising: at least one rotatably mounted flywheel, a traction element, and a brake element, increasing or decreasing the rotational energy of the at least one rotatably mounted flywheel using said traction element which is wound up and designated for acting on the at least one rotatably mounted flywheel in a first pull-out training phase followed by a winding-up training phase; wherein during the winding-up training phase the at least one rotatably mounted flywheel continues to rotate in a same direction of rotation as imparted during the first pullout training phase;

changing the rotational direction of the at least one rotatably mounted flywheel during a second pull-out training phase subsequent to the first pull-out training phase, wherein the direction of rotation of the at least one rotatably mounted flywheel in the first pull-out training phase is opposite of the direction of rotation of the at least one rotatably mounted flywheel in the second pull-out training phase;

braking the at least one rotatably mounted flywheel in a controlled manner by said brake element, wherein for endurance training, said brake element engages the at least one rotatably mounted flywheel by continuously dissipating energy by applying a braking force to the at least one rotatably mounted flywheel at least in the winding-up training phase and wherein for strength training, said brake element disengages the at least one rotatably mounted flywheel at least in the winding-up training phase; and measuring exercise conditions.

2. The method according to claim 1, wherein braking includes increasing the braking effect as the speed of rotation increases.

3. The method according to claim 1, wherein braking includes controlling the brake element by a control arrangement.

4. The method according to claim 3, further comprising detecting a concentric phase and an eccentric phase by the control arrangement comprising sensor elements.

5. The method according to claim 3 wherein controlling includes controlling as a function dependent on the speed of rotation of the at least one rotatably mounted flywheel.

6. The method according to claim 1, wherein braking includes friction braking.

7. The method according to claim 1, wherein braking includes fluid braking.

8. The method according to claim 1, wherein braking includes induction braking.

9. The method according to claim 1, wherein braking includes electrical braking.

10. The method according to claim 1, wherein the speed of movement and the exerted force during muscle contraction or muscle lengthening and the action of the brake element are influenced by changing the moment of inertia of the at least one rotatably mounted flywheel.

11. The method according to claim 1, further comprising recording exercise conditions.

12. An exercise apparatus for exercising muscles of a person and measuring exercise conditions, comprising:

at least one rotatably mounted flywheel;

a wound-up traction element operably connected to the at least one rotatably mounted flywheel; and a brake element operably connected to the at least one rotatably mounted flywheel for braking the at least one rotatably mounted flywheel in a controlled manner, wherein the at least rotatably mounted flywheel loads the relevant muscles of a person exercising by increasing or decreasing the rotational energy of the at least one rotatably mounted flywheel with the wound-up traction element, wherein the at least one rotatably mounted flywheel is acted upon during a first pull-out training phase followed by a winding-up training phase, wherein during the winding-up training phase, the at least one rotatably mounted flywheel continues to rotate in a same direction of rotation as imparted during the first pull-out training phase and the flywheel changes rotational direction in a second pull-out training phase subsequent to the first pull-out training phase, wherein the direction of rotation of the at least one rotatably mounted flywheel in the first pull-out training phase is opposite of the direction of rotation of the at least one rotatably mounted flywheel in the second pull-out training phase; and wherein for endurance training, the brake element engages the at least one rotatably mounted flywheel by continuously dissipating energy by applying a braking force to the at least one rotatably mounted flywheel at least in the winding-up training phase and wherein for strength training, the brake element disengages the at least one rotatably mounted flywheel at least in the winding-up training phase.

13. The apparatus according to claim 12, wherein the traction element is wound up around an axle, which axle is coupled to the at least one rotatably mounted flywheel.

14. The apparatus according to claim 12, wherein the brake element can be uncoupled in order to permit an engageable and disengageable braking action.

15. The apparatus according to claim 12, wherein the brake element is designed to act progressively, the braking effect increasing as the speed of rotation increases.

16. The apparatus according to claim 12, comprising a control arrangement for controlling the braking action of the brake element.

17. The apparatus according to claim 16, wherein the control arrangement comprises sensor elements designed to detect a concentric phase and an eccentric phase.

18. The apparatus according to claim 17, the sensor elements comprises a first sensor designed to detect a change in rotation of the at least one rotatably mounted flywheel, and a second sensor designed to detect when a run-out phase changes over to a run-in phase.

19. The apparatus according to claim 16, wherein the control arrangement comprises a control element designed to control the brake element by means of a function which is dependent on the speed of rotation of the at least one rotatably mounted flywheel.

20. The apparatus according to claim 12, wherein the brake element is designed to brake the at least one rotatably mounted flywheel by means of friction.

21. The apparatus according to claim 12, wherein the brake element comprises a brake part designed to brake the at least one rotatably mounted flywheel by direct contact with the periphery of the flywheel, where the brake part is formed by at least one of a brake band, a brake shoe, and a brake block.

22. The apparatus according to claim 12, wherein the brake element comprises a brake part designed to brake the at least one rotatably mounted flywheel by direct contact with at least one of the wheel's sides, where the brake part is formed, by at least one of a brake shoe and brake block.

23. The apparatus according to claim 12, wherein the brake element is designed to brake the at least one rotatably mounted flywheel by frictional resistance with a fluid.

24. The apparatus according to claim 12, wherein the brake element comprises blades arranged at the periphery of the at least one rotatably mounted flywheel, said blades being designed such that, upon rotation of the at least one rotatably mounted flywheel, they brake the latter by frictional resistance with a fluid.

25. The apparatus according to claim 12, wherein the brake element is to brake the at least one rotatably mounted flywheel by means of induction.

26. The apparatus according to claim 12, wherein the brake element comprises at least one permanent magnet, the at least one permanent magnet being arranged on the flywheel such that the magnetic field brakes the at least one rotatably mounted flywheel.

27. The apparatus according to claim 12, wherein the brake element comprises an electromagnet comprising at least one coil coupled to a current source, the coils being arranged on the flywheel such that the generated magnetic field brakes the at least one rotatably mounted flywheel during rotation.

28. The apparatus according to claim 12, wherein the brake element is designed to brake the at least one rotatably mounted flywheel by means of electricity.

29. The apparatus according to claim 12, wherein the brake element comprises an electric motor or a generator designed to brake the at least one rotatably mounted flywheel by means of a generated resistance.

30. The apparatus according to claim 12, wherein the at least one rotatably mounted flywheel comprises a first flywheel and a second flywheel, the brake element being designed to act directly on one of the flywheels.

31. The apparatus according to claim 12, wherein the at least one rotatably mounted flywheel can be replaced in order to change its moment of inertia for influencing the speed of movement and exerted force during muscle contraction and muscle lengthening, and the action of the brake element.

32. The apparatus according to claim 12, comprising measuring elements are provided in connection with said traction element, the measuring elements being designed to measure and record the traction force, the rotation speed, and a run-in speed.

33. The apparatus according to claim 32, wherein the measuring elements comprise an electric motor/generator designed to brake the at least one rotatably mounted flywheel, for measuring and recording the rotation speed.

34. The apparatus according to claim 33, wherein the electric motor/generator is designed to generate power for operating the measuring equipment and a display.

35. The apparatus according to claim 12, wherein, for exercising in a weightless environment, said at least one rotatably mounted flywheel is arranged on a seat or bench part designed to support the person exercising, said part being releasably anchored by spring devices.

36. The apparatus according to claim 35, wherein the seat or bench part comprises a slide which is displaceable along said part and on which the person exercising is intended to lie or sit.

37. The apparatus according to claim 35, comprising a carriage, displaceable along the part, is designed to be acted on by means of the legs of the person exercising and to influence said rotational energy (E(kin)) of the at least one rotatably mounted flywheel.

38. The apparatus according to claim 35, wherein the at least one rotatably mounted flywheel is arranged under the plane on which the person exercising is sitting or lying.

39. The apparatus according to claim 35, wherein the at least one rotatably mounted flywheel is designed to be acted on, by the person exercising, via an articulated lever arm which is connected to the traction element and is designed to be acted on between the articulated suspension and the connection to the traction element.

40. The apparatus according to claim 39, characterized in that, for influencing the relationship between exerted force and the speed of muscle contraction or muscle lengthening, the position of the centre of rotation of the at least one rotatably mounted flywheel relative to the lever arm is intended to be varied.

41. The apparatus according to claim 12, comprising a safety system comprising devices to control the movement of the of the at least one rotatably mounted flywheel to protect users and/or flywheel.

42. The apparatus according to claim 41 wherein the safety system comprises an emergency brake designed in such a way that, in the event of an uncontrolled run-in of the traction element, it is acted upon by the handle of the traction element, or by a device connected to the handle, in such a way that the emergency brake brakes the at least one rotatably mounted flywheel.

43. The apparatus according to claim 42, wherein the safety system comprises a disengaging element designed to disengage the flywheel from the axle at a predetermined torque of said at least one rotatably mounted flywheel.

44. The apparatus according to claim 43, wherein the disengaging element comprises an exchangeable breakpin coupled between the hub of the at least one rotatably mounted flywheel and the axle and designed to be shorn off at a predetermined torque.

45. The apparatus according to claim 41, wherein the safety system comprises a resettable slipping clutch which is designed such that, at a predetermined torque of the at least one rotatably mounted flywheel, the at least one rotatably mounted flywheel is disengaged from the axle in such a way that it slips against the latter.

* * * * *